United States Patent [19]

Sager

[11] Patent Number: 5,016,440

[45] Date of Patent: May 21, 1991

[54] APPARATUS FOR DELIVERING A CONTROLLABLE VARIABLE FLOW OF PRESSURIZED FLUID

[76] Inventor: William F. Sager, 1552 John Anderson Dr., Ormond Beach, Fla. 32074

[21] Appl. No.: 421,353

[22] Filed: Oct. 13, 1989

[51] Int. Cl.[5] ..... F16D 31/02

[52] U.S. Cl. ..... 60/429; 60/486; 417/429

[58] Field of Search ..... 417/429; 60/428, 429, 60/486

[56] References Cited

U.S. PATENT DOCUMENTS

| | | | |
|---|---|---|---|
| 3,972,187 | 8/1976 | Ital et al. | 60/428 |
| 4,017,216 | 4/1977 | Moore | 60/428 |
| 4,024,710 | 5/1977 | Zelle | 60/486 |
| 4,077,211 | 3/1978 | Fricke | 60/429 |
| 4,115,033 | 9/1978 | Kleineisel et al. | 60/428 |
| 4,164,119 | 8/1979 | Parquet | 60/428 |
| 4,184,331 | 1/1980 | Bentley | 60/486 |
| 4,359,130 | 11/1982 | Kirkham | 60/428 |
| 4,476,679 | 10/1984 | Sato | 60/429 |
| 4,545,201 | 10/1985 | Backe et al. | 60/429 |
| 4,750,005 | 6/1988 | Piatt et al. | 417/429 |
| 4,798,050 | 1/1989 | Nakamura et al. | 60/428 |

*Primary Examiner*—Ronald C. Capossela
*Attorney, Agent, or Firm*—Garrettson Ellis

[57] ABSTRACT

Apparatus is provided for delivering a controllable, variable flow of pressurized fluid. Conduits define a circulating fluid flow system, the flow system passing through a transducer for transferring energy as a mechanical input or output to or from pressurized fluid circulating in the system. At least first and second volumetric pumps are connected to conduits of the flow system in parallel relation to each other and in flow communication with the transducer. An operating shaft, preferably a single shaft, engages the first and second pumps. Valves and piping are provided for selectively shunting and isolating the first and second pumps from the fluid flow system. Thus, energy applied to the fluid flow system through either the shaft or transducer may be applied to the other of the shaft or transducer with variable pressure and flow velocity in the flow system, depending on whether one or both of the pumps are in operating mode with the flow system.

26 Claims, 1 Drawing Sheet

APPARATUS FOR DELIVERING A CONTROLLABLE VARIABLE FLOW OF PRESSURIZED FLUID

BACKGROUND OF THE INVENTION

The invention of this application is an apparatus for delivering a controllable, variable flow of pressurized fluid, and may be used in wide variety of environments where such an apparatus is desired. For example, the apparatus of this invention may be used as a transmission for vehicles or any other device where energy from an energy source is to be converted to either a higher power or a higher velocity form of energy.

For use as a transmission, the apparatus of this invention can operate entirely without gears, being typically entirely hydraulic or pneumatic in its operation, but for the preferred use of gear pumps. As an advantage of the apparatus, it can be designed to pass through a series of pumping states that are equivalent to a large number of separate gear settings, for example 13 or more gear settings with very simple equipment which is of relatively low cost.

Thus, the apparatus of this invention may serve as a simplified replacement for complex transmissions and for other uses in vehicles and elsewhere.

DESCRIPTION OF THE INVENTION

The apparatus of this invention is for delivering a controllable, variable flow of pressurized fluid, and comprises conduits which define a circulating fluid flow system. The fluid flow system passes through transducer means for either transferring energy as an input, or transferring energy as an output, to or from pressurized fluids circulating in the system.

At least first and second volumetric pump means are connected to conduits of the flow system in parallel flow relation to each other and in flow relation with the transducer. A "volumetric pump" transfers constant volumes of fluids as it operates, irrespective of varying pressures.

Operating shaft means are provided which engage the first and second pump means. Means are also provided, typically in the form of three way valves, for selectively isolating the first and second pump means from the fluid flow system.

Thus, energy applied to the fluid flow system through either the shaft means or the transducer may be applied to the other of the shaft means and the transducer, with variable pressure and fluid flow velocity in the flow system, depending on whether one or both pump means are in operating mode with the flow system. In other words, if the first pump means is placed into an isolated, shunting mode so that it does not pump fluid to the transducer, then the rate of fluid pumped to the transducer will be dependent only on the second pump means. Other things being equal, the back pressure of the fluid pumped by the second pump means and its flow volume will be different than in the circumstance where both pump means are activated and pumping together in parallel relation.

In the former case where only the second pump is active, the back pressure of the fluid pumped can be higher since the volume of the fluid pumped is lower, the exact values being subject to the power of the input, either through the transducer means or the operating shaft means. In the latter case, when both pumps are in operation, a greater unit flow of fluid will pass, but the maximum back pressure will thus be reduced if the power input remains the same. Hence the former, one pump situation is analogous to "low gear", while the latter two pump situation is analogous to "high gear". Larger amounts of flowing fluid at lower pressure can cause more rapid operation of the power output means, but with lower power output per unit volume of fluid pumped. Lesser amounts of fluid pumped can be at higher back pressures, and thus can generate more power per unit volume of fluid pumped, when the power input is constant for the two situations.

Preferably, the first and second volumetric pump means are mounted on a single shaft of the operating shaft means. It is also preferable for the volumetric pump means to comprise rotary gear pumps of any desired volumetric pump design. Preferably, the rotary pumps may utilize a design of rotary pump as described in Sager U.S. patent application Ser. No. 371,257, filed June 26, 1989, and entitled Rotary Pump Having Helical Gear Teeth.

It is also preferred for the first and second volumetric, and preferably rotary gear, pumps to be of differing pumping capacities while in operating mode with the system. It then becomes possible to provide a large variety of pumping capacities, for results similar to that of a transmission with a high number of alternative gears having differing gear ratios. For example, it is preferred for at least three volumetric pumps to be present, with the second volumetric pump having three times the pumping volume capacity of the first pump per cycle, and the third volumetric pump having nine times the pumping volume capacity per cycle of the first pump.

As a preferred feature of this invention, it is possible to cause one or more of the volumetric pumps to exert a subtractive function on the fluid being pumped, with the effect that the three pumps having capacities as described above are capable of providing a total of 13 different pumping volumes per cycle ranging in whole integers from 1 to 13 fold.

Hence, it is preferred in this invention for the circulating fluid flow system to include valves and conduits that selectively permit at least one of the volumetric pumps present to pump fluid in the fluid flow system from between the last named one volumetric pump and the transducer means to a region of the fluid flow system on the side of the last-named pump which is opposed to the transducer means. At the same time, other of the volumetric pump means pump a greater flow volume of fluid in a flow direction opposite to the above. It is by this means that at least one of the volumetric pumps can exert a subtractive function in the pumping of fluid through the transducer means, to provide the greater variety of overall pumping flow rates described above. This can be accomplished with substantially no energetic cost, for efficient operation.

The apparatus of this invention is well suited for use in a vehicle transmission or other energy conversion functions as may be desired.

DESCRIPTION OF SPECIFIC EMBODIMENTS

Figure 1:
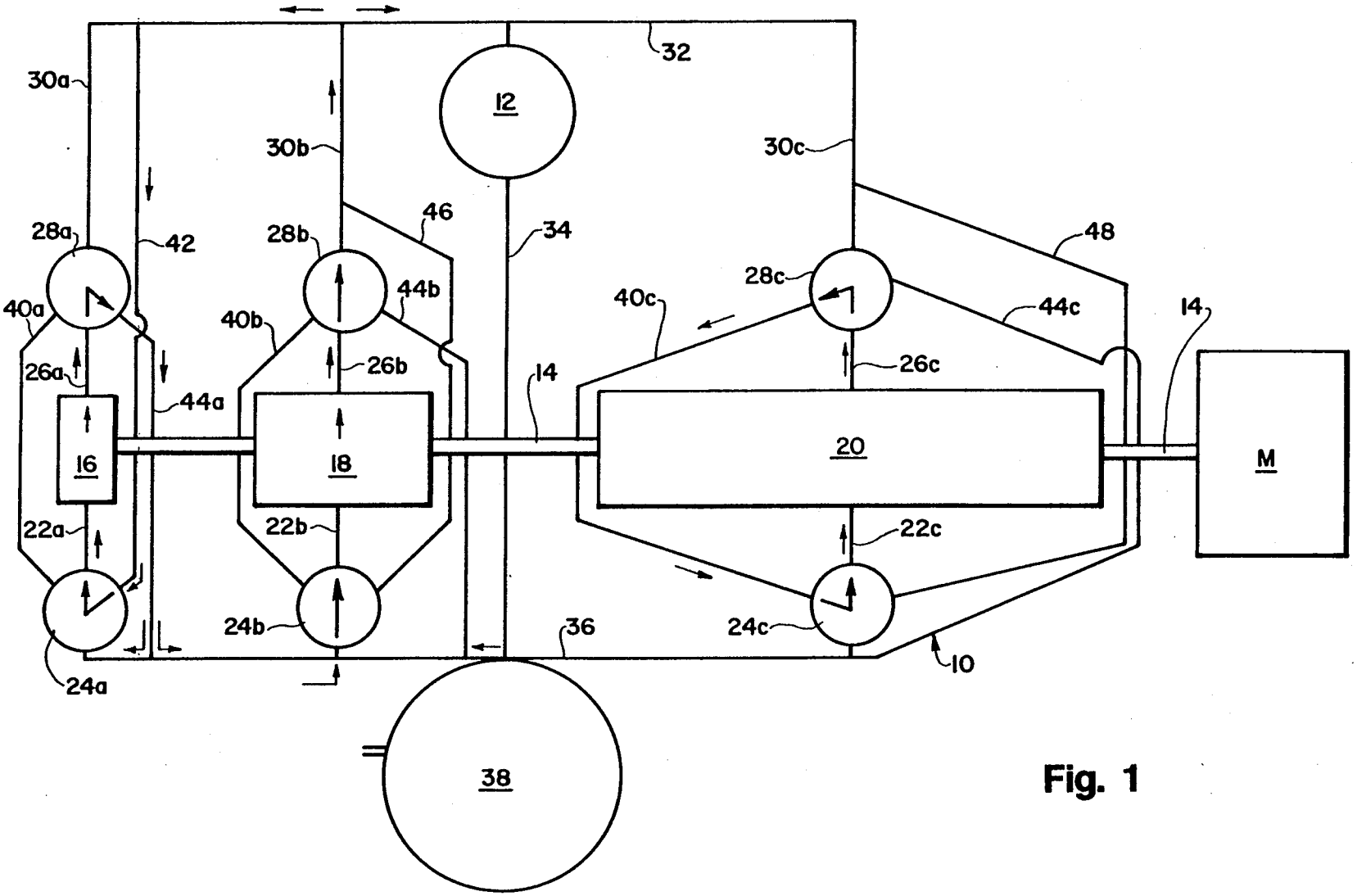
FIG. 1 is a schematic view of the apparatus of this invention adapted for use as a vehicle transmission.

Referring to FIG. 1, hydraulic or pneumatic apparatus 10 comprises an assembly of pumps and conduits which can be used to transfer power between motor M and transducer 12. Motor M may be a standard vehicle engine, the power output of which is shaft 14. Transducer 12 may be any conventional device for converting the energy of flowing, pressurized fluid into torque or other forms of energy, for example to operate the wheels of the vehicle in which the apparatus of FIG. 1 is carried.

There are mounted on shaft 14 three separate volumetric rotary gear pumps 16, 18, 20, which pumps may be, for example, rotary gear pumps of any desired design. Accordingly, pumps 16, 18, 20 rotate with shaft 14, being driven by motor M.

The system of this invention is typically hydraulic rather that pneumatic, with a hydraulic input line 22*a*, 22*b*, 22*c* communicating respectively between three way control valves 24*a*, 24*b*, 24*c* and the inlet of each of pumps 16, 18, 20. Output lines 26*a*, 26*b*, 26*c* communicate between the output of each pump 16, 18, 20 to respective second three way control valves 28*a*, 28*b*, 28*c*. When permitted by the respective valves 24*a*, 24*b*, 24*c* and 28*a*, 28*b*, 28*c*, pumps 16, 18, 20 respectively pump pressurized hydraulic fluid through branch lines 30*a*, 30*b*, 30*c* to collector line 32, and thence to transducer 12.

Energy from motor M is transmitted to rotary pumps 16, 18, 20. The energy is then transmitted to pressurized hydraulic fluid, which is pumped via branch lines 30*a*, 30*b*, 30*c* and collector line 32 to transducer 12, where the energy of the fluid pressure can be converted to torque that operates the wheels, at a speed dependent on the flow rate of hydraulic fluid passing through transducer 12. From there, the depressurized hydraulic fluid passes through exhaust line 34 to recycle via distributor line 36 to the respective inlets of valves 24*a*, 24*b*, 24*c*. A conventional fluid reservoir 38 is provided to accommodate for fluid loss and to receive excess fluid in a manner conventional to hydraulic technology.

In the above-described flow scheme, each of pumps 16, 18, 20 is pumping forwardly from distributor line 36 to collector line 32, so that as motor M turns shaft 14, the maximum possible flow rate of fluid pumped is provided to collector line 32 and transducer 12.

As one preferred embodiment, the pumping capacity of rotary gear pump 18, per rotation of shaft 14, is three times that of the pumping capacity of rotary gear pump 16. Also, the pumping capacity of rotary pump 20 is nine times, per shaft rotation, that of rotary gear pump 16. With this relationship, and with the arrangements of conduits and valving as described herein, it becomes possible to provide flow rates which range integrally from 1 to 13 units of flow provided to transducer !2 per rotation of shaft 14. By the appropriate selection of one of these thirteen alternate flow rates, the apparatus of this invention can act like a conventional transmission having 13 different gear settings.

Needless to say, the invention may be used to provide other arrangements of flow settings as well. For example, by the addition of another pump with a flow capacity which is 27 times that of pump 16, per rotation of shaft 14, it becomes possible to provide an apparatus with 40 different integral flow rates. With a fifth pump, 121 flow rates are possible.

Any or all of pumps 16, 18, 20 can be set by their respective valves 24, 28 to a shunting mode where rotation of shaft 14 causes any or all of the pumps to recirculate hydraulic fluid, without any pumping of fluid from distributor line 36 to collector line 32. To accomplish this, valves 24*a*, 24*b*, or 24*c* and 28*a*, 28*b*, or 28*c* are set to cause cyclic flow between the respective valves, pumps 16, 18, 20, and the connected lines 40*a*, 40*b*, or 40*c*. For example, one may cause pump 20 to shunt as shaft 14 rotates by moving valves 24*c*, 28*c* to connect lines 22*c*, 26*c*, and 40*c* so that pump 20 pumps in a cyclic flow path through those lines. Thus, as motor M exerts its power through shaft 14, only pumps 16 and 18 provide actual pumping from distributor line 36 to collector line 32 and transducer 12, for a pumping flow rate which is four times that of the flow capacity of pump 16. Such a configuration corresponds to something akin to "second gear", since the maximum flow rate of the apparatus shown is 13 times the single flow rate of pump 16. At such a relatively low flow rate, the back pressure of fluid in collector line 32 can be relatively high, to drive the vehicle wheels through transducer 12 at a relatively low speed, but with high power.

It can be seen that any of pumps 16, 18 or 20 can be set into the shunting mode by the respective action of the valves 24, 28, so that the flow through any of the pumps is shunted around via the respective line 40*a*, 40*b*, or 40*c* from the pump outlet back to its inlet as shaft 14 rotates.

Each of pumps 16, 18, and 20 may also be set by their respective valves 24, 28 to pump in reverse, so that the apparatus of this invention is capable of providing a transmission that operates in reverse with the same levels of power delivery and speed as it provides in the forward direction. Also, the reverse operation capability of each individual pump provides a substantial increase in the varying flow volumes and pressures of hydraulic fluid delivered to transducer 12, for smooth operation as a vehicle transmission or for any other use.

Referring to pump 16, in the reverse operation mode, valves 24*a*, 28*a* may be set so that fluid from collector line 32 may flow through line 42 to valve 24*a*, and from there through inlet line 22*a*, pump 16, and outlet line 26*a*. From there the pumped hydraulic fluid passes through valve 28*a*, and reverse line 44*a*, back to distributor line 36.

Pumps 18 and 20 have a similar mode of operation except that, in the reverse pumping mode, fluid from collector line 32 passes through a portion of the respective outlet lines 30*b*, 30*c* , and then through the respective intersecting reverse lines 46, 48 which respectively communicate with valves 24*b*, 24*c*. Then, as in all modes, fluid is pumped forwardly through pumps 18, 20, to valves 28*b*, 28*c*. In the reverse mode, valves 28*b*, 28*c* are set to direct fluid through the respective reverse lines 44*b*, 44*c*, causing the respective pumps 18, 20 to pump fluid from collector line 32 back to distributor line 36.

It can be seen that the arrangement of flow line 42 in pump !6 is slightly different from the corresponding arrangement of flow lines 46, 48. This is primarily for purposes of illustration, since either of the arrangements are suitable with any of the valves.

Thus, each of pumps 16, 18, 20 have three modes of operation as illustrated, being controlled by their respective valves 24, 28. These three modes of operation are the forward pumping mode, the shunting mode, and the reverse pumping mode, all of which modes of operation relate only to the flow pattern around pumps 16, 18, 20 and do not involve any reverse operation of the pumps themselves. The arrows around pump 18 illustrate the forward mode. The arrows around pump 16 illustrate the reverse mode. The arrows around pump 20 illustrate the shunting mode. Thus the pumping rate of the FIG. 1 apparatus as shown is twice the rate of pump 16.

This versatility of operation which is provided by the respective valves 24, 28 may be used to provide thirteen different flow and power settings to or from transducer 12. The apparatus may be set up as previously described so that motor M rotates the respective pumps 16, 18, 20. However, power may be introduced into the system from transducer 12, creating pressurized fluid which rotates pumps 16, 18, 20 and shaft 14, to transfer power to motor M or another appropriate power output device, if desired.

Specifically, the power setting of the system of FIG. 1 may of course be 0 if all three pumps 16, 18, 20 are in their shunting mode, with flow passing between the respective valves 24, 28 and through the respective flow lines 40. Then, the system may be shifted to provide a flow setting of one volume unit of hydraulic fluid per rotation of shaft 14 by shifting valves 24*a*, 28*a* to the positive flow setting, so that pump 16 pumps fluid from line 36 to line 32 and transducer 12. This is equivalent to the lowest forward gear in the system.

The forward hydraulic fluid flow may be doubled, and the power per unit volume of fluid halved, at a constant power setting of motor M, by shifting pump 18 to the forward pumping mode (pump 18 pumps three volume units per rotation of shaft 14), and shifting pump 16 to the reverse pumping mode, so that on unit per rotation is withdrawn from collector line 32 by pump 16 and pumped back to distributor line 36. Thus, a net pumping effect of two volume units per rotation is provided.

To then obtain a pumping volume of 3 volume units per rotation of shaft 14, pump 16 is shifted by valves 24*a*, 28*a* to the shunting mode. To obtain a pumping speed of 4 units per shaft rotation, pump 16 is shifted to the forward pumping mode. To obtain a pumping speed of 5 units per shaft rotation, pump 20 (which pumps 9 volume units per shaft rotation) is shifted to the forward pumping mode, while both of pumps 16 and 18 are shifted to the reverse pumping mode.

Further readily apparent shifts of the pumping modes can provide added, integral pumping volumes per shaft rotation of 6 to 13 integral volume units, so that the apparatus of this invention has any one of 13 pumping volume settings per rotation of shaft 14. A chart of respective flow settings which provide the given overall fluid flow rates to transducer 12 is shown immediately below .

The plus sign symbolizes the forward flow mode. The zero signifies the shunting mode, and the minus sign signifies the reverse flow mode for each valve and each setting.

| Valve 16 | Valve 18 | Valve 20 | Flow to Transducer 12 |
|---|---|---|---|
| + | 0 | 0 | 1 |
| − | + | 0 | 2 |
| 0 | + | 0 | 3 |
| + | + | 0 | 4 |
| − | − | + | 5 |
| 0 | − | + | 6 |
| + | − | + | 7 |
| − | 0 | + | 8 |
| 0 | 0 | + | 9 |
| + | 0 | + | 10 |
| − | + | + | 11 |
| 0 | + | + | 12 |
| + | + | + | 13 |

-continued

| Valve 16 | Valve 18 | Valve 20 | Flow to Transducer 12 |
|---|---|---|---|
| 0 | 0 | 0 | neutral |
| − | − | 0 | one reverse position |

It should be noted that by a simple reversal of the plus signs to minus and the minus signs to plus in any given mode, one can achieve with this apparatus a series of 13 delivery rates in a reverse direction from transducer 12 to motor M.

Preferably, the respective valves 24, 28 may be opened and closed with timing to overlap each other, so that there is a relatively slow onset and shut-off of flow through the respective conduits. This can serve the function of a clutch, to provide smooth transition between the various flow settings.

As an alternative embodiment of the device of FIG. 1, rotary pump 16 may pump one volume unit of hydraulic fluid per rotation of shaft 14, while pump 18 pumps two volume units of fluid, and pump 20 pumps six volume units of fluid per shaft rotation. In this circumstance, nine different pumping modes are possible with the transmission of this apparatus, but a very smooth transition between the flow modes may be utilized. In this embodiment, it is particularly preferred for valves 24*a*, 28*a* to be of the smooth transition type, for example a faucet-type ball valve or another valve in which the initiation and termination of flow is relatively gradual rather than sudden. Then, if desired, valves 24*b*, 24*c* and 28*b*, 28*c* may be of the fast-acting type.

As before, to pump to transducer 12 at a flow rate of one volume unit per shaft rotation, pump 16 is set by its valves to pump in the forward flow mode, while pumps 18 and 20 are in the shunting mode. Then, for smooth shifting of transmission, the philosophy of this system is to always change the setting of valves 24*a*, 28*a* when a change of flow rate is taking place, so that their smooth shifting characteristic may be utilized.

To accomplish this,. the system may be set into a different pumping mode of the same value of one, by rapidly shifting pump 18 into the positive flow mode and shifting pump 16 into the reverse flow mode. Then, by relatively gradually shifting pump 16 from the reverse flow to the shunting flow mode, the system can smoothly transfer from a flow output to transducer 12 of one volume unit per shaft rotation to two volume units.

The transfer of flow from two volume units to three volume units can be gradually made by shifting pump 16 from the shunting mode to the positive flow mode. Then, a shift in the system may take place which does not change the flow rate by shifting pump 20 to the positive flow mode (pump 20 having a flow rate of 6 units per shaft rotation) while simultaneously shifting pumps 16, 18 to the reverse flow mode. Then, a smooth transition may be made by a pumping output to transducer 12 of four units per shaft rotation by shifting pump 16 from the reverse flow mode to the shunting mode. Then, another smooth transition may be made by shifting pump 16 from the shunting mode to the forward flow mode.

Following this, another internal shift without a change in output may be made by shifting pump 18 to the shunting mode and pump 16 to the reverse flow mode. Thereafter, another smooth transition from 5 volume units to 6 volume units per shaft rotation may be achieved by the smooth shifting of pump 16 to the shunting mode. Pump 16 may shift to the forward mode for a smooth transition to a flow of 7 volume units. The shifting to 8 and 9 volume units is done in analogous manner.

It can be seen that by such a system, smooth shifting may take place between the various flow outputs, which range in volume per shaft rotation of from 1 to 9 integral units.

If greater versatility of flow conditions is required, another, larger pump may be added to provide a four pump system, or a five pump system, or more as may be desired. Also, it can be seen that this system may be modified by varying pump capacity to pump with flow output in various stages that are fractionally related to the lowest pumping output rather than being integrally related stages.

The respective control valves 24, 28 may be controlled by an electronic microprocessor system if desired, to provide an automatic transmission, or the system may be manually controlled by the operator as well.

Thus, a gearless transmission is provided of low cost and high versatility, for use in any desired environment. The above has been offered for illustrative purposes only, and is not intended to limit the scope of the invention of this application, which is as defined in the claims below.

That which is claimed is:

1. Apparatus for delivering a controllable, variable flow of pressurized fluid, which comprises:

conduits defining a circulating fluid flow system, said flow system passing through transducer means for transferring energy as a mechanical input or output to or from pressurized fluid circulating in said system; at least first and second nonadjustable, constant volumetric pump means operatively connected between high pressure and lower pressure fluid flow conduits of said flow system, said pump means being in parallel flow relation to each other and in operative flow communication with said transducer for transferring power through and out of said apparatus; operating shaft means engaging said first and second pump means, and means for selectively isolating fluid flow through said first and second pump means from said transducer, whereby energy applied to said fluid flow system through one of said shaft means or transducer may be applied to the other of said shaft means or transducer with variable pressure and fluid flow velocity in said flow system, depending on whether one or both pump means are in operating mode with the flow system.

2. The apparatus of claim 1 in which said first and second volumetric pump means are mounted on a single shaft of said operating shaft means.

3. The apparatus of claim 1 in which said first and second volumetric pump means are of differing pumping capacities while in operating mode with the system

4. The apparatus of claim 1 in which said volumetric pump means comprise rotary gear pumps.

5. The apparatus of claim 1 in which at least three volumetric pumps are present, said second volumetric pump having three times the pumping volume capacity per cycle of the first volumetric pump, the third volumetric pump having nine times the pumping volume capacity per cycle of the first volumetric pump.

6. The apparatus of claim 5 in which said circulating fluid flow system includes valves and conduits that selectively permit at least one volumetric pump present to pump fluid in said fluid flow system from between the last-named pump and the transducer means to a region of the fluid flow system on the side of the last-named pump opposed to the transducer means, while other volumetric pump means pump a greater flow volume of fluid in a flow direction opposite to the above, whereby said at least one volumetric pump can exert a subtractive function in the pumping of fluid through the transducer means, to provide a greater variety of overall pumping flow rates through the transducer means.

7. The apparatus of claim 1 in which said circulating fluid flow system includes valves and conduits that selectively permit at least one volumetric pump present to pump fluid in said fluid flow system from between the last-named pump and the transducer means to a region of the fluid flow system on the side of the last-named pump opposed to the transducer means, while other volumetric pump means pump a greater flow volume of fluid in a flow direction opposite to the above, whereby said at least one volumetric pump can exert a subtractive function in the pumping of fluid through the pumping flow rates through the transducer means.

8. The apparatus of claim 7 in which at least said one volumetric pump is connected to a shunting pump circuit whereby, while shunting, said one pump does not contribute to the overall pumping flow so that a variety of controllable flow rates and maximum back pressures may be provided by variable operation of said one pump present in either shunting flow, forward flow, or reverse flow.

9. The apparatus of claim 1 which is used as a vehicle transmission.

10. The apparatus of claim 1 in which each of said volumetric pump means are equipped with valve means to control the respective flow pattern of each volumetric pump means between forward flow, shunting flow, and reverse flow.

11. The apparatus of claim 10 in which the at least said first volumetric pump means is controlled by valve means of the gradual turn-on and shut-off type for smooth transitions.

12. The method of pumping fluid with variable flow rate and variable maximum back pressure, which comprises:

pumping said fluid through a flow system connected to a plurality of nonadjustable, constant volumetric pump means connected in parallel flow relation to each other and carried on operating shaft means, said pump means communicating through conduits to pump pressurized fluid to transducer means or to receive pressurized fluid from said transducer means, while causing by means of valving and conduits at least one of said volumetric pump means to pump in the reverse direction from other pump means, the pumping capacity of said pump which pumps in reverse direction being less than the pumping capacity of the other pump means.

13. The method of claim 12 which includes the step of providing to each of said pump means a shunting pump circuit whereby while shunting, a pump of said pump means does not contribute to the overall pumping flow, so that a large variety of controllable flow rates and maximum back pressures may be provided by variable operation of the pumps present in either shunting flow, forward flow, or reverse flow.

14. The method of claim 12 in which said plurality of volumetric pump means comprises rotary gear pumps.

15. The method of claim 14 in which said plurality of pump means are all connected on a single shaft of operating shaft means.

16. The method of claim 12 in which at least three volumetric pumps are present, a second of said volumetric pumps having three times the pumping volume capacity per cycle of a first volumetric pump, a third volumetric pump having nine times the pumping volume capacity per cycle of said first volumetric pump.

17. The method of claim 12 in which at least three volumetric pumps are present, a second volumetric pump having two times the pumping volume capacity per cycle of a first volumetric pump, a third volumetric pump having six times the pumping volume capacity per cycle of the first volumetric pump.

18. The method of claim 17 in which said first volumetric pump is equipped with valve means to control its flow pattern between forward flow, shunting flow, and reverse flow, said valve means being of the gradual turn-on and shut-off type for smooth transition, said second and third pumps also having valves that control the operation between forward flow, shunting flow, and reverse flow, the valves controlling said second and third pumps being of fast, abrupt acting type.

19. Apparatus for delivering a controllable, variable flow of pressurized fluid, which comprises:

conduits defining a circulating fluid flow system, said flow system passing through a transducer for transferring energy as a mechanical input or output to or from pressurized fluid circulating in said system;

at least first and second volumetric pump means operatively connected between high pressure and lower pressure fluid flow conduits of said flow system in parallel flow relation to each other and in operative flow communication with said transducer for transferring power through and out of said apparatus;

said first and second volumetric pump means being or differing pumping capacities while in operating mode with the system;

each of said volumetric pump means being rotary gear type pumps mounted on a single operating shaft which engages said first and second pump means, and means for selectively isolating fluid flow through said first and second pump means from said transducer; whereby energy applied to said fluid flow system through one of said shaft or transducer may be applied to the other of said shaft or transducer with variable pressure and fluid flow velocity in said flow system, depending on whether one or both pump means are in operating mode with the transducer.

20. The apparatus of claim 19 in which said circulating fluid flow system includes valves and conduits that selectively permit at least one volumetric rotary pump present to pump fluid in said fluid flow system from between the last-named pump and the transducer to a region of the fluid flow system on the side of the last-named pump opposed to the transducer, while other volumetric pump means pump a greater flow volume of fluid in a flow direction opposite to the above, whereby at least one volumetric pump can exert a subtractive function in the pumping of fluids through the transducer, to provide a greater variety of overall pumping flow rates through the transducer.

21. The apparatus of claim 20 in which at least three volumetric, rotary pumps are present, said second volumetric, rotary pump having three times the pumping volume capacity for shaft rotation of the first rotary pump, the third volumetric, rotary pump having nine times the pumping volume capacity per shaft rotation of the first rotary pump, said third rotary pump being carried on the same shaft as the first and second pumps.

22. The apparatus of claim 20 in which at least three volumetric, rotary pumps are present, said second volumetric, rotary pump having twice the pumping volume capacity for shaft rotation of the first volumetric, rotary pump, the third volumetric, rotary pump having six times the pumping volume capacity per shaft rotation of the first volumetric, rotary pump, the first volumetric, rotary pump being equipped with relatively gradually acting valves for smooth transitions between states of flow.

23. The apparatus of claim 20 in which said at least one volumetric rotary pump is connected to a shunting pump circuit whereby, while shunting, said one rotary pump does not contribute to the overall pumping flow so that a variety of controllable flow rates and maximum back pressures may be provided by variable operation of the one pump in either shunting flow, forward flow or reverse flow.

24. The apparatus of claim 23 in which all of the rotary pumps present are equipped with means for selectively providing said shunting flow, forward flow, and reverse flow, at least said one volumetric, rotary pump being equipped with relatively gradually acting valve means for smooth transitions between states of flow.

25. A method of pumping fluid with variable flow rate and variable maximum back pressure, which comprises:

pumping said fluid through a flow system connected to a plurality of nonadjustable, constant volumetric pump means connected in parallel flow relation to each other, while causing by means of valving and conduits at least one of said volumetric pump means to pump in the reverse direction from the other pump means, the pumping capacity of said pump which pumps in reverse direction being less than the pumping capacity of the other pump means, and also including the step of pumping a third of said pump means in a shunting pump circuit whereby, while shunting, said third pump means does not contribute to the overall pumping flow.

26. The method of claim 25 in which said plurality of volumetric pump means comprise rotary gear pumps which are all connected on a single shaft.

* * * * *